US011007625B2

(12) United States Patent
Chen et al.

(10) Patent No.: US 11,007,625 B2
(45) Date of Patent: May 18, 2021

(54) TWO-STAGE UNIVERSAL JOINT

(71) Applicant: YUAN LI HSING INDUSTRIAL CO., LTD., Taichung (TW)

(72) Inventors: Hui-Chien Chen, Taichung (TW); Chia-Yi Chen, Taichung (TW)

(73) Assignee: YUAN LI HSING INDUSTRIAL CO., LTD., Taichung (TW)

( * ) Notice: Subject to any disclaimer, the term of this patent is extended or adjusted under 35 U.S.C. 154(b) by 355 days.

(21) Appl. No.: 16/148,669

(22) Filed: Oct. 1, 2018

(65) Prior Publication Data

US 2020/0101585 A1 Apr. 2, 2020

(51) Int. Cl.
*B25B 23/00* (2006.01)

(52) U.S. Cl.
CPC ..... *B25B 23/0014* (2013.01); *B25B 23/0035* (2013.01)

(58) Field of Classification Search
CPC ..... B25B 23/0014; B25B 23/0028; B25B 23/0035; F16D 3/16; F16D 3/18; F16D 3/185
See application file for complete search history.

(56) References Cited

U.S. PATENT DOCUMENTS 3,897,703 A * 8/1975 Phipps ..... B25B 13/56 81/177.75
7,278,342 B1 * 10/2007 Chang ..... B25B 23/0028 81/177.75
8,176,817 B2 * 5/2012 Liu ..... B25B 23/0028 81/177.75
8,366,339 B2 * 2/2013 Lin ..... F16C 11/0604 403/57
8,671,808 B2 * 3/2014 Huang ..... B25B 23/0028 81/177.75
9,776,310 B2 * 10/2017 Chen ..... B25B 23/0028
2011/0281659 A1 * 11/2011 Yamashita ..... B25B 13/481 464/159
2017/0254365 A1 * 9/2017 Chen ..... B25B 23/0035
2019/0283221 A1 * 9/2019 Chen ..... B25B 23/0028
2020/0061783 A1 * 2/2020 Chen ..... B25B 13/481
2020/0072294 A1 * 3/2020 Chen ..... F16D 3/20

* cited by examiner

*Primary Examiner* — David B. Thomas

(74) *Attorney, Agent, or Firm* — Muncy, Geissler, Olds & Lowe, P.C.

(57) ABSTRACT

A two-stage universal joint includes a sleeve member, a driving member, and an elastic member. The sleeve member defines an axial direction and has a sleeve portion and a connection portion. The sleeve portion has a receiving groove having plural positioning protrusions extending axially on an inner wall thereof. One of the positioning protrusions has a recessed portion. The driving portion has a polygonal ball-joint having plural arc-face sections. The polygonal ball-joint is inserted into the receiving groove. The driving member is slidable with respect to the sleeve member between a first position and a second position. The polygonal ball-joint has a biasing member tending to move outward.

7 Claims, 6 Drawing Sheets

TWO-STAGE UNIVERSAL JOINT

BACKGROUND OF THE INVENTION

Field of the Invention

The present invention relates to a two-stage universal joint.

Description of the Prior Art

A universal joint is a hand tool for rotating freely. The universal joint includes a ball-joint seat and a driving rod. The driving rod has a ball-joint at an end thereof. The ball-joint is slidably disposed on the ball-joint seat and is unable to rotate with respect to the ball-joint seat. The driving rod is slidable with respect to the ball-joint seat between a fixed position and a pivot position. When the driving rod is located at the fixed position, the radial protrusion of the driving rod is restricted by the ball-joint seat to be unable to pivot with respect to the ball-joint seat. When the driving rod is pulled outward from the ball-joint seat to the pivot position, the radial protrusion of the driving rod is not restricted by the ball-joint seat to be rotatable with respect to the ball-joint seat. Thereby, the universal joint can be pivoted for operation in a narrow space.

However, the driving rod is unable to be positioned at specific position easily, so the driving rod is freely slidable between the fixed position and the pivot position. Thus, the user has to adjust the position of the driving rod often.

SUMMARY OF THE INVENTION

The main object of the present invention is to provide a two-stage universal joint which is able to make the driving member fixed at two different positions. In addition, the driving member and the sleeve member have sufficient structure strength to bear torsion.

To achieve the above and other objects, the two-stage universal joint includes a sleeve member, a driving member, and an elastic member.

The sleeve member defines an axial direction and has a sleeve portion and a connection portion. The sleeve portion has a receiving groove. The receiving groove has a plurality of axially-extended positioning protrusions formed on an inner wall of the receiving groove. One of the positioning protrusions has a recessed portion. The driving member has a polygonal ball-joint. The polygonal ball-joint has a plurality of arc-face sections. The polygonal ball-joint is inserted into the receiving groove. Each of the arc-face sections abuts against one of the positioning protrusions. The driving member is slidable with respect to the sleeve member between a first position and a second position. The polygonal ball-joint has a biasing member tending to provide an elastic force outward along a radial direction. The elastic member is biased between a bottom of the receiving groove and the polygonal ball-joint so that the driving member tends to move toward the second position. When the driving member is located at the first position, the biasing member abuts against the recessed portion, and the driving member is unpivotable around the polygonal ball-joint with respect to the sleeve member. When the driving member is moved toward the second position, the biasing member leaves the recessed portion, and the driving member is pushed by the elastic member to the second position so that the driving member is pivotable around the polygonal ball joint with respect to the sleeve member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
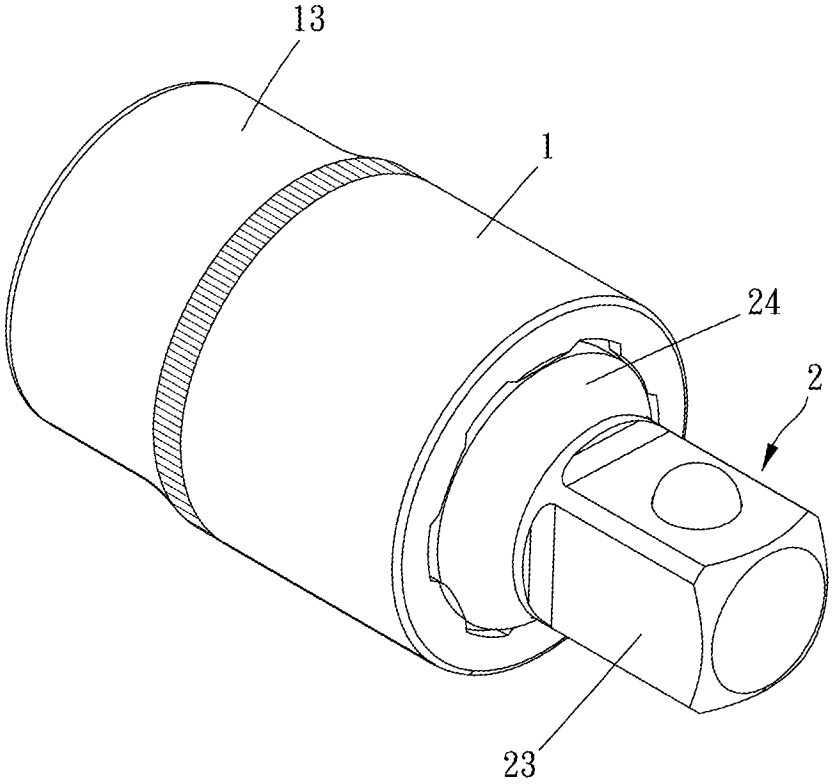
FIG. 1 and FIG. 2 are stereograms of the present invention.
Figure 2:
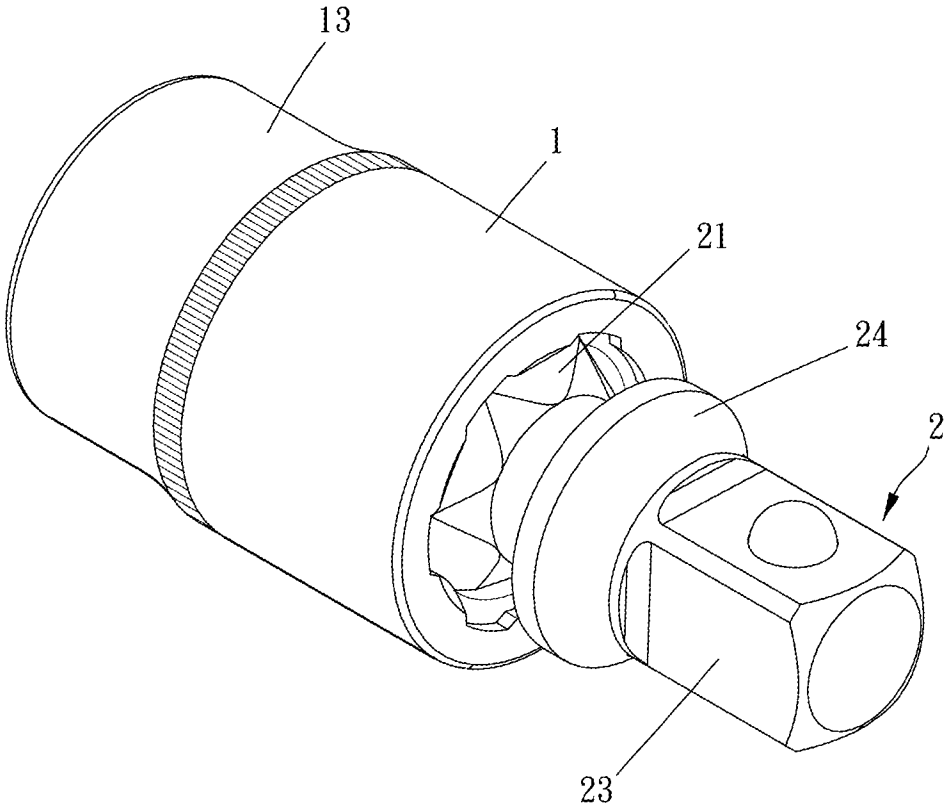
Figure 3:
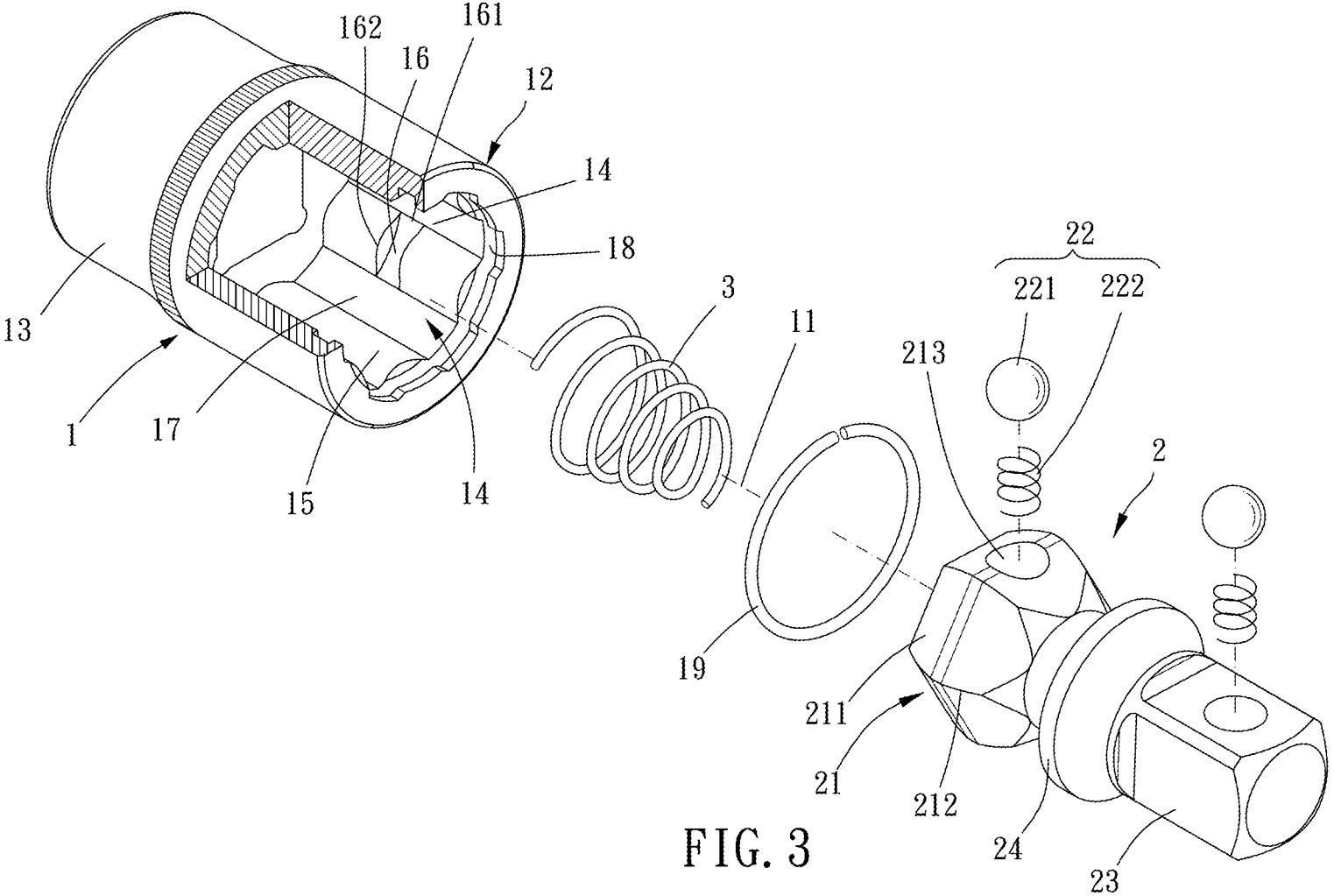
FIG. 3 is a breakdown drawing of the present invention.
Figure 4:
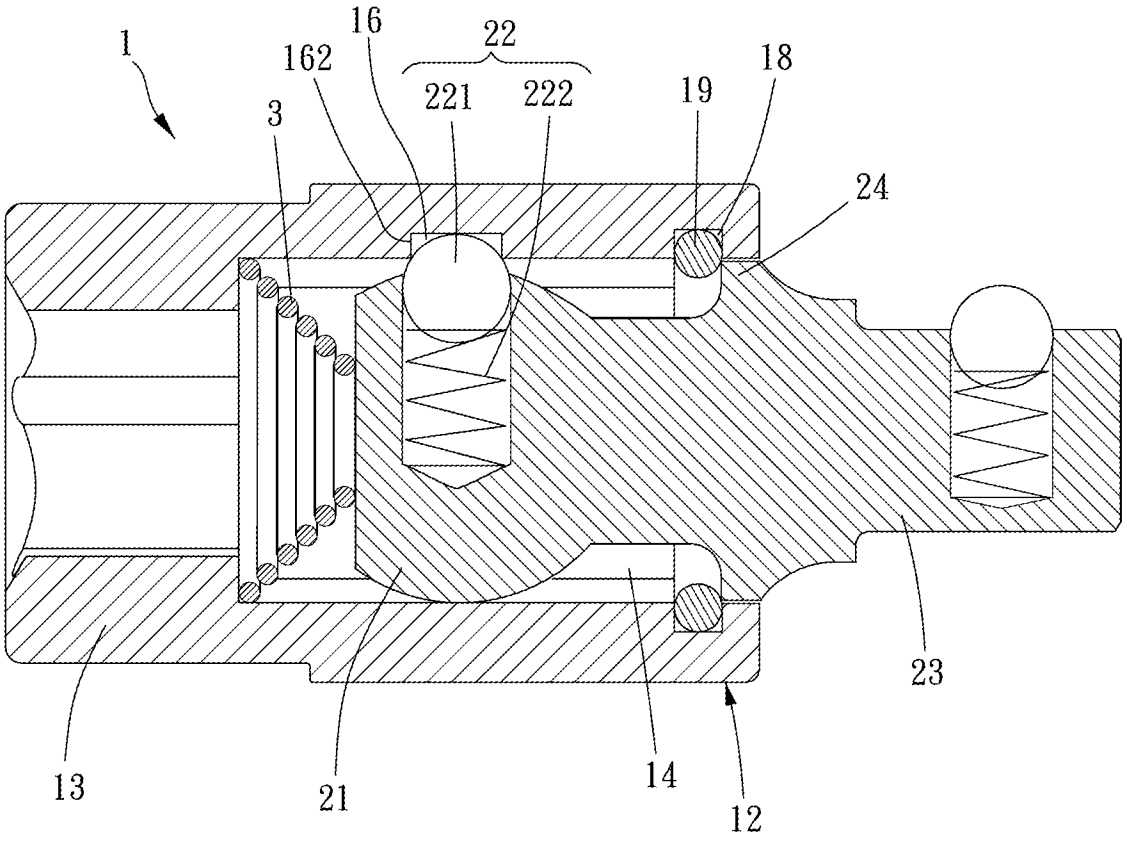
FIG. 4 to FIG. 6 are profiles of the present invention during operation.
Figure 5:
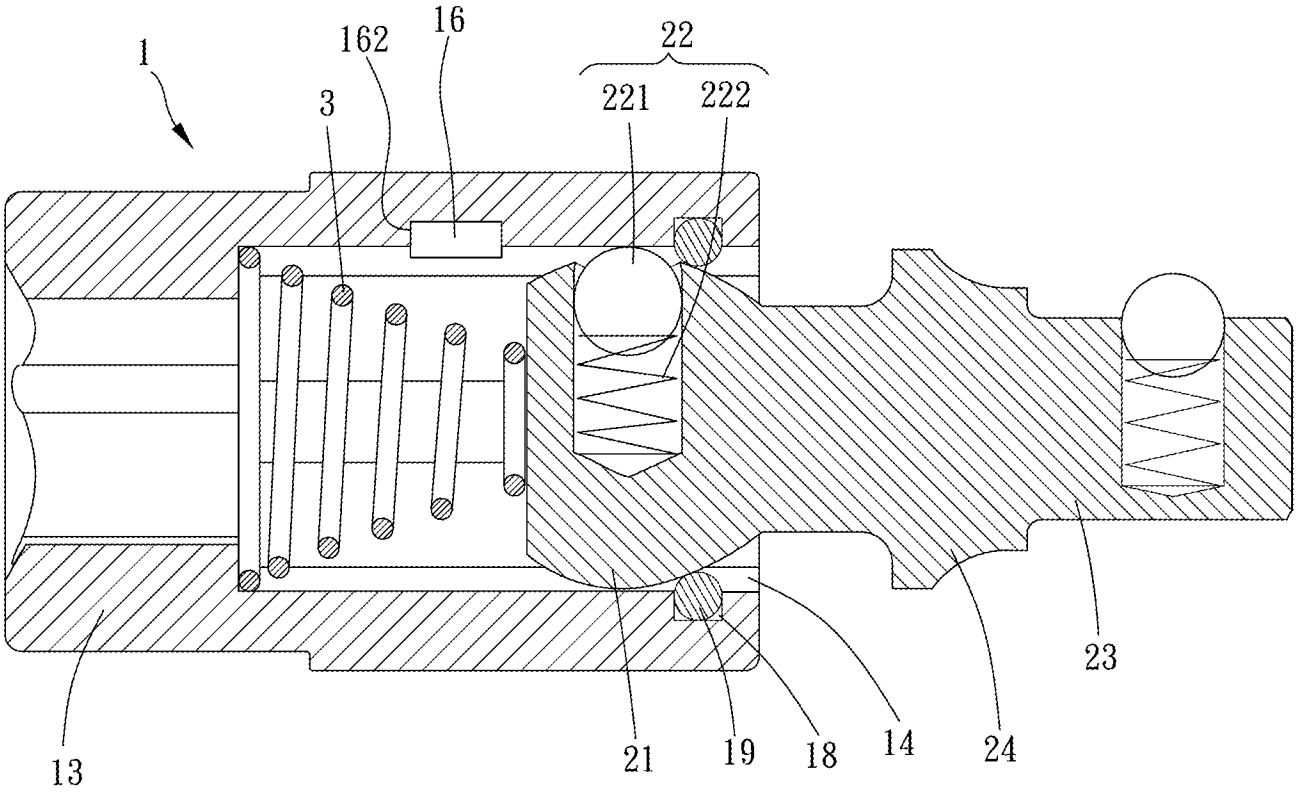
Figure 6:
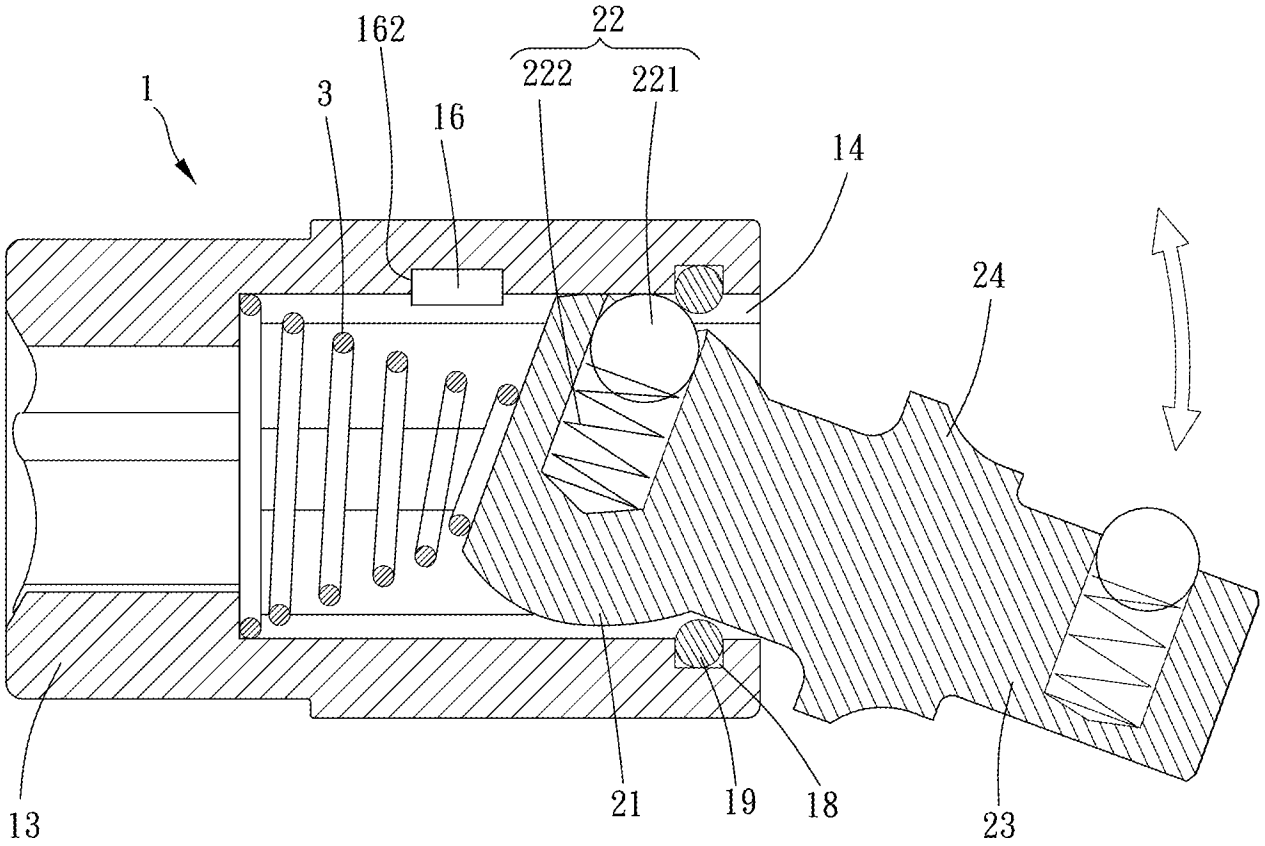

Please refer to FIG. 1 to FIG. 6, the two-stage universal joint of the present invention includes a sleeve member 1, a driving member 2, and an elastic member 3.

The sleeve member 1 defines an axial direction 11 and has a sleeve portion 12 and a connection portion 13. The sleeve portion 12 has a receiving groove 14. The receiving groove 14 has a plurality of axially-extended positioning protrusions 15 formed on an inner wall of the receiving groove 14. One of the positioning protrusions 15 has a recessed portion 16. The connection portion 13 is adapted for connecting with a rotation tool.

The driving member 2 has a polygonal ball joint 21. The polygonal ball-joint 21 has a plurality of arc-face sections 211. The polygonal ball-joint 21 is inserted into the receiving groove 14. Each of the arc-face sections 211 abuts against one of the positioning protrusions 15. The driving member 2 is slidable with respect to the sleeve member 1 between a first position and a second position. The polygonal ball-joint 21 has a biasing member 22 tending to provide an elastic force outward along a radial direction. In the present embodiment, both the polygonal ball-joint 21 and the receiving groove 14 are hexagons.

The elastic member 3 is biased between a bottom of the receiving groove 14 and the polygonal ball-joint 21 so that the driving member 2 tends to move toward the second position.

When the driving member 2 is located at the second position, the biasing member 22 abuts against the recessed portion 16, and the driving member 2 is unable to pivot around the polygonal ball-joint 21 with respect to the sleeve member 1. In other words, the driving member 2 and the sleeve member 1 are aligned, and the biasing member 22 abuts against the recessed portion 16 so that the driving member 2 is unable to move to the second position freely. When the driving member 2 is moved toward the second position, the biasing member 22 leaves the recessed portion 16, and the driving member 2 is pushed by the elastic member 3 to move to the second position so that the driving member 2 is pivotable around the polygonal ball-joint 21 with respect to the sleeve member 1. Thus, the sleeve member 1 and the driving member 2 are rotatable relatively. If the driving member 2 is to move to the first position, the user can exert a force to overcome the elastic force of the elastic member 3 so that the driving member 2 may move back to the first position. Thus, the driving member 2 can be positioned at the first position or the second position quickly, and may not slide freely with respect to the sleeve member 1. In the present embodiment, the elastic member 3 is tapered from the connection portion 13 toward the receiving groove 14 and abuts against a terminal face of the polygonal ball-joint 21 toward the connection portion 13.

The receiving groove 14 is formed with a plurality of positioning recesses 17 extending axially. The positioning protrusions 15 and the positioning recesses 17 are arranged alternately along a circumferential direction of the receiving groove 14. A corner portion 212 is formed between any two adjacent ones of the arc-face sections 211. Each of the corner portions 212 abuts against one of the positioning recesses 17 so that the polygonal ball-joint 21 is prevented from rotating with respect to the sleeve portion 12 around the axial direction 11. In the present embodiment, each of the positioning protrusions 15 has a convex arc-surface, and each of the positioning protrusions 15 has a thickness tapered toward two sides along a circumferential direction of the sleeve member 1. Thus, when the polygonal ball-joint 21 is located at the second position, the driving member 2 is rotatable with respect to the sleeve member 1 around the polygonal ball-joint 21 easily.

Two lateral faces 162 of the recessed portion 16 along the axial direction extend along the radial direction of the sleeve member 1 so that the biasing member 22 is prevented from leaving the recessed portion 16 freely. The recessed portion 16 has an inclined face 161 extending to one of the positioning protrusions 17. Besides, a ratio of an axial length of the recessed portion 16 to a depth of the receiving groove 14 is ranged from 1:7 to 1.5:7. In the present embodiment, the ratio of an axial length of the recessed portion 16 to a depth of the receiving groove 14 is 1.3:7 to provide a stronger engagement between the recessed portion 16 and the biasing member 22.

The biasing member 22 includes a positioning member 221 and a spring 222. The polygonal ball-joint 21 is formed with a receiving hole 213. The positioning member 221 is slidably arranged in the receiving hole 213, and the spring 222 is biased between a bottom of the receiving hole 213 and the positioning member 221 so that the positioning member 221 tends to move outward. In the present embodiment, the positioning member 221 is a rolling ball to prevent the positioning member 221 from being stuck in the recessed portion 16.

The driving member 2 is integrally formed with a working portion 23 and a radial flange 24. The radial flange 24 is arranged between the working portion 23 and the polygonal ball-joint 21. The working portion 23 is adapted for connecting with a fixing member or a tool socket. When the driving member 2 is located at the first position, the radial flange 24 abuts against the inner wall of the receiving groove 14. When the driving member 2 is located at the second position, the radial flange 24 and the inner wall of the receiving groove 14 are apart from each other.

Preferably, the inner wall of the receiving groove 14 is formed with an annular groove 18 at an end thereof remote from the connection portion 13. The annular groove 18 detachably receives a stopping member 19 therein. When the driving member 2 is moved to the second position, the stopping member 19 abuts against the polygonal ball-joint 21 so that the polygonal ball-joint 21 is prevented from leaving the receiving groove 14. In the present embodiment, the stopping member 19 is a C-shaped buckle (C-ring) detachably arranged in the annular groove 18 to make it easier to install or detach.

In conclusion, the driving member of the present invention can be quickly positioned at the first position or the second position and may not slide freely with respect to the sleeve member so that the two-stage universal joint is more convenient to use.

What is claimed is:

1. A two-stage universal joint, including:

a sleeve member, defining an axial direction, having a sleeve portion and a connection portion, the sleeve portion having a receiving groove, the receiving groove having a plurality of axially-extended positioning protrusions formed on an inner wall of the receiving groove, one of the positioning protrusions having a recessed portion;

a driving member, having a polygonal ball-joint, the polygonal ball-joint having a plurality of arc-face sections, the polygonal ball-joint being inserted into the receiving groove, each of the arc-face sections abutting against one of the positioning protrusions, the driving member being slidable with respect to the sleeve member between a first position and a second position, the polygonal ball-joint having a biasing member tending to provide an elastic force outward along a radial direction;

an elastic member, biased between a bottom of the receiving groove and the polygonal ball-joint so that the driving member tends to move toward the second position;

wherein when the driving member is located at the first position, the biasing member abuts against the recessed portion and the driving member is unpivotable around the polygonal ball-joint with respect to the sleeve member; when the driving member is moved toward the second position, the biasing member leaves the recessed portion, the driving member is pushed by the elastic member to the second position so that the driving member is pivotable around the polygonal ball-joint with respect to the sleeve member;

wherein two lateral faces of the recessed portion along the axial direction extend along the radial direction of the sleeve member;

wherein the receiving groove is formed with a plurality of positioning recesses extending axially, the positioning protrusions and the positioning recesses are arranged alternately along a circumferential direction of the receiving groove, a corner portion is formed between any two adjacent ones of the arc-face sections, each of the corner portions abuts against one of the positioning recesses;

wherein the recessed portion has an inclined face extending to one of the positioning protrusions;

wherein the inner wall of the receiving groove is formed with an annular groove at an end thereof remote from the connection portion, the annular groove detachably receives a stopping member therein, the recessed portion is located between an end of the positioning protrusion and the annular groove, and in the axial direction the annular groove is narrower than the recessed portion;

wherein the recessed portion is disposed circumferentially through the positioning protrusion and in communication with two of the plurality of positioning recesses.

2. The two-stage universal joint of claim 1, wherein each of the positioning protrusions has a convex arc-surface, each of the positioning protrusions has a thickness tapered toward two sides along a circumferential direction of the sleeve member.

3. The two-stage universal joint of claim 1, wherein the biasing member includes a positioning member and a spring, the polygonal ball-joint is formed with a receiving hole, the positioning member is slidably arranged in the receiving hole, the spring is biased between a bottom of the receiving hole and the positioning member, so that the positioning member tends to move outward.

4. The two-stage universal joint of claim 1, wherein the driving member is integrally formed with a working portion and a radial flange, the radial flange is arranged between the working portion and the polygonal ball-joint, the radial flange abuts against the inner wall of the receiving groove when the driving member is located at the first position, the radial flange and the inner wall of the receiving groove are apart from each other when the driving member is located at the second position.

5. The two-stage universal joint of claim 1, wherein when the driving member is moved to the second position, the stopping member abuts against the polygonal ball-joint so that the polygonal ball-joint is prevented from leaving the receiving groove.

6. The two-stage universal joint of claim 5, wherein the stopping member is a C-shaped buckle detachably arranged in the annular groove.

7. The two-stage universal joint of claim 1, wherein a ratio of an axial length of the recessed portion to a depth of the receiving groove is ranged from 1:7 to 1.5:7.

* * * * *